US010832851B2

(12) United States Patent
Inaba

(10) Patent No.: US 10,832,851 B2
(45) Date of Patent: Nov. 10, 2020

(54) REACTOR AND MANUFACTURING METHOD FOR REACTOR

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventor: Kazuhiro Inaba, Mie (JP)

(73) Assignees: AutoNetworks Technologies, Ltd., Yokkaichi (JP); Sumitomo Wiring Systems, Ltd., Yokkaichi (JP); Sumitomo Electric Industries, Ltd., Osaka (JP)

( * ) Notice: Subject to any disclaimer, the term of this patent is extended or adjusted under 35 U.S.C. 154(b) by 51 days.

(21) Appl. No.: 15/565,571

(22) PCT Filed: Apr. 8, 2016

(86) PCT No.: PCT/JP2016/061591
§ 371 (c)(1),
(2) Date: Oct. 10, 2017

(87) PCT Pub. No.: WO2016/167198
PCT Pub. Date: Oct. 20, 2016

(65) Prior Publication Data

US 2018/0122550 A1 May 3, 2018

(30) Foreign Application Priority Data

Apr. 14, 2015 (JP) ..... 2015-082402

(51) Int. Cl.
*H01F 3/14* (2006.01)
*H01F 27/255* (2006.01)
(Continued)

(52) U.S. Cl.
CPC ..... *H01F 27/255* (2013.01); *H01F 3/10* (2013.01); *H01F 3/14* (2013.01); *H01F 27/263* (2013.01);
(Continued)

(58) Field of Classification Search
CPC ..... H01F 3/10; H01F 3/14; H01F 3/08; H01F 27/255; H01F 27/2823; H01F 27/263; H01F 37/00; H01F 41/0206
(Continued)

(56) References Cited

U.S. PATENT DOCUMENTS 3,609,615 A * 9/1971 Parker ..... H01F 17/043 336/178
4,210,947 A 7/1980 Koizumi
(Continued)

FOREIGN PATENT DOCUMENTS

JP S54-063338 A 5/1979
JP S57-157126 U 10/1982
(Continued)

OTHER PUBLICATIONS

Search Report for PCT/JP2016/061591, dated Jun. 21, 2016.

*Primary Examiner* — Mang Tin Bik Lian
(74) *Attorney, Agent, or Firm* — Honigman LLP

(57) ABSTRACT

A reactor is provided that can reduce or alleviate stress that can be applied to a magnetic core, and also has excellent manufacturability, and a reactor manufacturing method is also provided. The reactor includes a coil and a magnetic core that includes a plurality of core pieces and a gap member that is interposed between at least one set of core pieces, the magnetic core forming a closed magnetic circuit when the coil becomes excited. At least one gap member is a resin foam gap member that includes, in a contact region
(Continued)

that comes into contact with the core pieces, a resin foam portion constituted by resin foam.

3 Claims, 8 Drawing Sheets

(51) Int. Cl.
*H01F 37/00* (2006.01)
*H01F 3/10* (2006.01)
*H01F 27/26* (2006.01)
*H01F 27/28* (2006.01)
*H01F 41/02* (2006.01)

(52) U.S. Cl.
CPC ..... *H01F 27/2823* (2013.01); *H01F 37/00* (2013.01); *H01F 41/0206* (2013.01)

(58) Field of Classification Search
USPC ..... 336/212, 178, 233
See application file for complete search history.

(56) References Cited

U.S. PATENT DOCUMENTS 6,177,855 B1* 1/2001 Bouillot ..... H01F 3/14 336/100
2011/0025444 A1* 2/2011 Sugiyama ..... H01F 27/255 336/212
2012/0044033 A1 2/2012 Kawaguchi
2012/0119869 A1* 5/2012 Yamamoto ..... H01F 27/255 336/212
2013/0127579 A1* 5/2013 Ueno ..... H01F 37/00 336/212
2014/0050001 A1* 2/2014 Inaba ..... H01F 1/26 363/131
2014/0125440 A1* 5/2014 Ueno ..... H01F 37/00 336/65
2014/0140111 A1* 5/2014 Inaba ..... H01F 37/00 363/37
2014/0232508 A1* 8/2014 Inaba ..... H01F 37/00 336/233
2014/0247623 A1* 9/2014 Inaba ..... H01F 37/00 363/13
2014/0293655 A1* 10/2014 Inaba ..... H01F 27/255 363/15
2014/0320256 A1* 10/2014 Inaba ..... H01F 37/00 336/221
2015/0069853 A1* 3/2015 Wang ..... H02M 1/14 307/104
2015/0235749 A1* 8/2015 Huang ..... H01F 3/02 336/178

FOREIGN PATENT DOCUMENTS

JP 2010-263074 A 11/2010
JP 2011-159854 A 8/2011
JP 2013-004931 A 1/2013
JP 2013-197362 A 9/2013
JP 2015-012147 A 1/2015
JP 2015-053464 A 3/2015

* cited by examiner

REACTOR AND MANUFACTURING METHOD FOR REACTOR

CROSS-REFERENCE TO RELATED APPLICATIONS

This application is the U.S. national stage of PCT/JP2016/061591 filed Apr. 8, 2016, which claims priority of Japanese Patent Application No. JP 2015-082402 filed Apr. 14, 2015.

TECHNICAL FIELD

The present invention relates to a reactor for use in, for example, a constituent part of a vehicle-mounted DC-DC converter or power conversion apparatus installed in a vehicle such as a hybrid automobile, and relates to a reactor manufacturing method. In particular, the present invention relates to a reactor that can reduce or alleviate stress that can be applied to the magnetic core, and also has excellent manufacturability.

BACKGROUND

A reactor is one type of component of a circuit for performing a voltage step-up operation or step-down operation. A reactor includes a coil that has a tubular winding portion formed by winding a winding wire into a spiral shape, and a magnetic core that is disposed inside and outside of the winding portion and forms a closed magnetic circuit when the coil becomes excited. Some magnetic cores are formed by combining a plurality of core pieces whose main component is a soft magnetic material and a gap plate that is interposed between the core pieces and is constituted by a nonmagnetic material such as alumina. The core pieces and the gap plate can be integrated by, as described in JP 2013-004931A for example, using an epoxy-based adhesive or a urethane-based adhesive (paragraph of the specification) or a cold setting elastic adhesive (claim 1).

JP 2010-263074A discloses a magnetic core in which an elastic gap member made of an elastic material such as silicone rubber is interposed between core pieces, and integration is performed without using an adhesive. JP 2010-263074A discloses a configuration in which the coil, the magnetic core, and a plate spring that presses the magnetic core are assembled together and stored in a case, and these members are covered with an outer resin portion, and a configuration in which instead of the plate spring, the magnetic core is maintained in ring shape by being constricted with a band-shaped constriction member.

There is desire for a reactor that can reduce or alleviate stress that can be applied to the magnetic core, and also has excellent manufacturability.

In the case of using a thermosetting adhesive such as the epoxy-based adhesive described above, the core pieces are fixed firmly. However, as will be described later, portions of the core pieces in the vicinity of the connection between them can become mechanically weak points.

When a reactor is in use, the reactor is subjected to vibration attributed to magneto-striction, vibration produced by the automobile or the like to which the reactor is attached, and the like. Stress attributed to these types of vibration is applied to the magnetic core. If the core pieces are fixed firmly, this stress does not cause detachment at the interface between the core pieces and the adhesive, but rather can cause breakage or the like at portions of the core piece in the vicinity of the connection between them. In other words, there is a risk that the core pieces themselves become damaged. In particular, in the case where the constituent material of the core pieces is a composite material that includes a magnetic powder and a resin, due to containing a large amount of resin, the strength tends to degrade in comparison with the case where the core pieces are a compressed powder compact or a magnetic steel plate. Also, if a portion of the magnetic core that is not in the vicinity of the connection between core pieces, typically a portion exposed from the winding portion, is used as a portion for attachment to the installation target, portions that are in the vicinity of the connection between core pieces and are distant from the attachment portion can move to a certain extent with the attachment portion as the base point, and therefore such portions even more easily become weak points in terms of mechanical strength. For this reason, there is desire for the ability to reduce or alleviate stress that is applied to the magnetic core, and the core pieces in p articular.

In the case of using a cold setting elastic adhesive or an elastic gap member made of rubber or the like as described above, the material interposed between the core pieces is a solid body, thus transmitting vibration more easily than a gaseous body.

Furthermore, in the case of using an elastic gap member made of rubber or the like and not using an adhesive as described above, the manufacturability degrades.

Specifically, in order to maintain the assembled state of the core piece and the elastic gap members, it is necessary to provide the outer resin portion and also a separate member such as a plate spring or a band-shaped constriction member, thus increasing the number of process steps due to the outer resin portion formation step, the separate member disposition step, and the like, thereby inviting a decrease in manufacturability. In particular, the disposition of the plate spring and constriction with the band-shaped constriction member are performed in resistance to the biasing force provided by the elastic gap member, thus degrading workability. In the case of using an elastic adhesive, a case is also conceivable in which, in the elastic adhesive curing step, a separate member is needed in order to constrict the magnetic core such that the core pieces are brought closer to each other in resistance to the biasing force of the elastic adhesive in order to provide a predetermined gap length. The workability further degrades if a mechanism for adjusting the constriction amount or the like is disposed in order to prevent the constriction member or the band-shaped constriction member from excessively constricting the elastic gap member or the elastic adhesive and crushing the elastic gap member or the like.

In view of this, an object of the present invention is to provide a reactor that can reduce or alleviate stress that can be applied to the magnetic core, and also has excellent manufacturability.

Another object of the present invention is to provide a manufacturing method for a reactor that can easily manufacture a reactor that can reduce or alleviate stress that can be applied to the magnetic core.

SUMMARY

A reactor according to an aspect of the present invention includes: a coil; and a magnetic core that includes a plurality of core pieces and a gap member interposed between at least one set of the core pieces, the magnetic core forming a closed magnetic circuit when the coil becomes excited. At least one gap member is a resin foam gap member that includes, in a contact region that comes into contact with the core pieces, a resin foam portion constituted by resin foam.

A reactor manufacturing method according to an aspect of the present invention relates to a method for manufacturing a reactor by assembling together a coil and a magnetic core that includes a plurality of core pieces, the method including a disposition step and a foaming step described below.

(Disposition step) A step of disposing an unfoamed resin sheet between adjacent core pieces among the plurality of core pieces.

(Foaming step) A step of causing the unfoamed resin sheet to foam in a state where a gap between the core pieces between which the unfoamed resin sheets are interposed is restricted according to a predetermined gap length, to form a resin foam portion constituted by resin foam between the core pieces.

Advantageous Effects of Invention

The above reactor can reduce or alleviate stress that can be applied to the magnetic core, and also has excellent manufacturability.

The above manufacturing method for a reactor can easily manufacture a reactor that can reduce or alleviate stress that can be applied to the magnetic core.

DETAILED DESCRIPTION OF PREFERRED EMBODIMENTS

Figure 1:
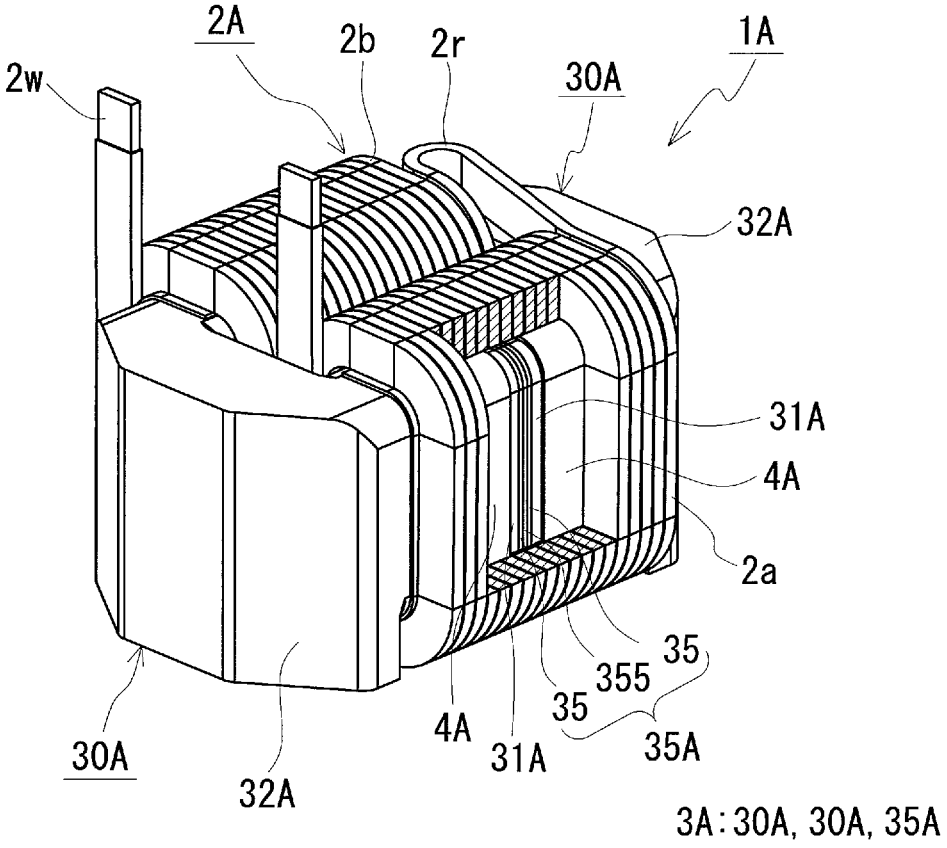
FIG. 1 is a schematic perspective view of a reactor of a first embodiment.

First, embodiments of the present invention will be listed and described.

(1) A reactor according to an aspect of the present invention includes: a coil; and a magnetic core that includes a plurality of core pieces and a gap member interposed between at least one set of the core pieces, the magnetic core forming a closed magnetic circuit when the coil becomes excited. At least one gap member is a resin foam gap member that includes, in a contact region that comes into contact with the core pieces, a resin foam portion constituted by resin foam.

In the above reactor, for the following reasons, it is possible to suppress damage such as breakage of portions of the core pieces in the vicinity of connections between the core pieces caused by stress that can be generated and applied due to vibration or the like during use. Also, for the following reasons, the above reactor has excellent manufacturability as well.

Damage Suppression Through Vibration Absorption and Stress Alleviation

The above reactor includes, between at least one set of core pieces, the resin foam gap member that includes the resin foam portion. The resin foam portion has undergone volumetric expansion in which the foamed resin contains air bubbles. In other words, it can be said that both a solid, which is the resin, and a gas, which is the air bubbles, are interposed between the core pieces. A gas is generally less likely to transmit vibration than a solid. For this reason, due to air bubbles being interposed between the core pieces, it is possible to reduce the transmission of vibration to the magnetic core (possible to absorb vibration) in comparison with the case of only a solid being interposed by the core pieces. Thus, it is possible to reduce or alleviate stress that is generated by vibration or the like and can be applied to the reactor. Even in the case where a portion of the magnetic core other than connection portions between the core pieces is used for attachment to the installation target, by reducing and absorbing the above-described vibration, it is possible to reduce or alleviate stress that is applied to the portions in the vicinity of connections between the core pieces.

Favorable Manufacturability

By using an unfoamed resin sheet as described below, the above configuration has excellent workability.

For example, if an unfoamed resin sheet is used, the resin foam portion can be formed easily. Here, the unfoamed resin sheet is thinner than the predetermined gap between the core pieces. However, up to the time when foaming is completed for example, the resin sheet can be supported by sandwiching the unfoamed resin sheet between the core pieces. At this time, it is desirable to dispose a restriction member or the like around the assembled magnetic core such that the gap between the core pieces is the predetermined gap length after foaming. Unlike a member used for constricting the above-described elastic gap member or the like, it is sufficient that the restriction member can simply hold the core pieces with the predetermined gap therebetween and suppress separation of the core pieces due to resin foaming, and therefore the restriction member can have a simple configuration. Also, there is no need to be disposed in resistance to the biasing force of elastic members, and the restriction member can be disposed easily.

In particular, if an unfoamed resin sheet that has adhesiveness is used, the state of being adhered to the core pieces and the later-described gap plate can be maintained by the resin sheet itself. For this reason, the coil and the core pieces with the unfoamed resin sheet attached thereto are assembled easily, the resin sheet is unlikely to undergo positional shift in the foaming step, there is no need to dispose a support member or the like for the resin sheet, thus achieving even more excellent workability. Even if the above-described restriction member is used when necessary, the restriction member can be disposed easily as described above, thus achieving excellent workability.

Furthermore, the thickness of the unfoamed resin sheet is different from the thickness of the resin foam portion included in the reactor, the resin sheet is thin, and the resin foam portion is thick. By using a material whose thickness changes in the manufacturing process in this way, there is no need to precisely adjust the thickness of the resin sheet. For example, in the case where the gap length is short, if a difficult-to-machine material such as an alumina plate is used as the gap member, precise polishing needs to be performed, and workability degrades. Extremely thin unfoamed resin sheets (e.g., 200 μm or less) are available, and by using a resin sheet that is thin but has a sufficiently large expansion rate, it is possible to ensure the predetermined gap length after foaming. Also, even if there is dimensional error in the core pieces, or there is dimensional error in the gap plate when using the later-described gap plate, for example, such dimensional error can be absorbed by the volumetric expansion of the resin foam, thus making it possible to use a core piece or a gap plate having somewhat low dimensional precision. In this way, material selection can be performed easily, and workability is excellent.

(2) In one example of an aspect of the above reactor, at least one resin foam gap member is entirely constituted by the resin foam portion.

In the above aspect, the resin foam gap member that is substantially entirely constituted by resin foam is provided between at least one set of core pieces. This resin foam gap member contains a large amount of air bubbles, and many air bubbles exist between the core pieces, and therefore this aspect is able to further alleviate the above-described stress. Also, in the above aspect, the resin foam gap member can be easily formed by causing the unfoamed resin sheet, which is interposed between the core piece, to foam in accordance with the gap between the core pieces, thus reducing the number of assembly parts, and achieving even more excellent manufacturability. All of the gap members included in the magnetic core can be the resin foam gap member that is substantially entirely constituted by resin foam (hereinafter, sometimes called a single-layer gap member).

(3) In one example of an aspect of the above reactor, at least one resin foam gap member includes a gap plate and the resin foam portion provided on one surface or two surfaces of the gap plate.

In the above aspect, the resin foam gap member that is constituted by the gap plate that substantially does not contain air bubbles and by the resin foam portion that contains air bubbles is provided between at least one set of core pieces. By providing the resin foam portion in contact with the core pieces, the above aspect is capable of alleviating the above-described stress. Also, in the above aspect, by providing the gap plate, the thickness of the resin foam portion can be reduced, the foaming time of the unfoamed resin sheet can be shortened, and it is possible to use a gap plate that has somewhat low dimensional precision as described above, and therefore manufacturability is excellent. All of the gap members included in the magnetic core can be the resin foam gap member that includes the gap plate and the resin foam portion (hereinafter, sometimes called a multilayer gap member). In the case where the magnetic core includes a plurality of gap members, it is possible to include a combination of the single-layer gap member described in (2) and the multilayer gap member described here in (3).

(4) In one example of an aspect of the above reactor, only one resin foam gap member is provided.

In the above aspect, the resin foam gap member is provided at one location in the magnetic core, and therefore there is a lower number of steps for disposing the unfoamed resin sheet between the core pieces in the manufacturing process, there are fewer portions where gap restriction between the core pieces is needed, and it is possible to precisely restrict the gap between the core piece, thus achieving even more excellent manufacturability. Depending on the shape of the core pieces, it is possible to eliminate the need for a member for restricting the gap, and manufacturability is excellent in view of this as well.

(5) In one example of an aspect of the above reactor, a constituent material constituting the core pieces is a composite material that includes a soft magnetic powder and a resin.

Although there are cases where a core piece constituted by a composite material has lower strength than the case of being constituted by a powder compact, a magnetic steel plate, or the like as described above, in the above aspect, the resin foam gap member that includes the resin foam portion is provided, thus making it possible to alleviate the above-described stress.

Also, the composite material contains a resin, and therefore it is easier to obtain a core piece that has a lower relative permeability than in the case of using a powder compact, a magnetic steel plate, or the like, and the gap length can be easily shorted in the magnetic core of the above aspect. Even in the case where the gap length is short, by using the resin foam gap member, material selection can be performed easily as described above, and therefore manufacturability is also excellent.

Alternatively, in the case where the gap length is short, even if the coil is disposed close to a portion of the magnetic core that is disposed inside the winding portion, it is possible to reduce loss (ohmic loss) caused by flux leakage. Also, in the case of providing a surface resin layer mainly constituted by resin contained in the composite material, the surface resin layer can be used as an insulation layer for insulation from the coil. For this reason, in the above aspect, the coil and the magnetic core can be close to each other, and compactness can be achieved.

(6) A reactor manufacturing method according to an aspect of the present invention relates to a method for manufacturing a reactor by assembling together a coil and a magnetic core that includes a plurality of core pieces, the method including a disposition step and a foaming step described below.

(Disposition step) A step of disposing an unfoamed resin sheet between adjacent core pieces among the plurality of core pieces.

(Foaming step) A step of causing the unfoamed resin sheet to foam in a state where a gap between the core pieces between which the unfoamed resin sheets are interposed is restricted according to a predetermined gap length, to form a resin foam portion constituted by resin foam between the core pieces.

In the above reactor manufacturing method, a reactor that includes a resin foam portion between core pieces can be manufactured by the simple step of causing an unfoamed resin sheet to foam while restricting the gap between the core pieces in which the resin sheet is interposed. This reactor includes the resin foam portion, thus making it possible to reduce or alleviate stress that can be applied to the magnetic core during use as described above.

Also, up to the time when foaming is completed for example, the unfoamed resin sheet interposed between the core pieces can be supported by sandwiching the unfoamed resin sheet between the set of core pieces themselves that are disposed facing each other, and even in the case of using a restriction member, it is possible to suppress separation of the core pieces from each other that accompanies foaming as described above, thus making it possible to easily dispose the restriction member. If the unfoamed resin sheet has adhesiveness sufficient to enable maintaining the state of being adhered to the core piece, or in the case of using a gap plate, has adhesiveness sufficient to enable maintaining the state where the resin sheet is adhered to the gap plate, it is possible to also easily perform assembly of the coil and the core pieces which the resin sheet is adhered. Furthermore, there are cases where it is possible to omit the restriction member and the disposition step for the same. Additionally, by using the unfoamed resin sheet, it is possible to use core pieces and a gap plate that have somewhat low dimensional precision as described above. In view of the above, the above manufacturing method for a reactor can easily manufacture a reactor that can reduce or alleviate stress that can be applied to the magnetic core.

DETAILED DESCRIPTION OF EMBODIMENTS OF THE PRESENT INVENTION

Hereinafter, reactors according to embodiments of the present invention will be described in detail with reference to the drawings. Reference signs that are the same in the drawings denote elements that have the same name. In the descriptions in the following embodiments, the installed state is the state in which the lower face of reactors 1A to 1D shown in FIGS. 1, 3, 5, and 7 are the installation faces. This installed state is an illustrative example, and a side face or the like can be the installation face. Also, in FIGS. 1, 3, 5, and 7, portions of the turns of coils 2A and 2C have been cut away so as to expose foaming resin gap members 35A, 35B, 35C, and 35D and the vicinity thereof in the winding portions 2*a* and 2*c*. In FIGS. 2, 4, 6, and 8, unfoamed resin sheets 350 and 352 are shown with an increased thickness in order to facilitate understanding.

First Embodiment

A reactor 1A of a first embodiment will be described below with reference to FIGS. 1 and 2.

Reactor

Overall Configuration

The reactor 1A includes a coil 2A that has a pair of winding portions 2*a* and 2*b* obtained by winding a winding wire 2*w* into a spiral shape, and a magnetic core 3A that has a plurality of core pieces 30A and a plurality of gap members interposed between the core pieces 30A. The magnetic core 3A is disposed inside and outside of the winding portions 2*a* and 2*b*, and forms a closed magnetic circuit when the coil 2A becomes excited. The reactor 1A is typically used in a state of being attached to an installation target such as a converter case with use of a fixing member (not shown) such as a bolt. A feature of the reactor 1A is that at least one of the gap members is a resin foam gap member 35A that includes a resin foam portion 35 constituted by a resin foam portion. Another feature is that the resin foam gap member 35A in this example includes one gap plate 355 and resin foam portions 35 respectively provided on the two surfaces of the gap plate 355. A further feature in this example is that the constituent material of the core pieces 30A is a composite material that includes a soft magnetic powder and a resin. The constituent elements will be described individually below.

Coil

Figure 2:
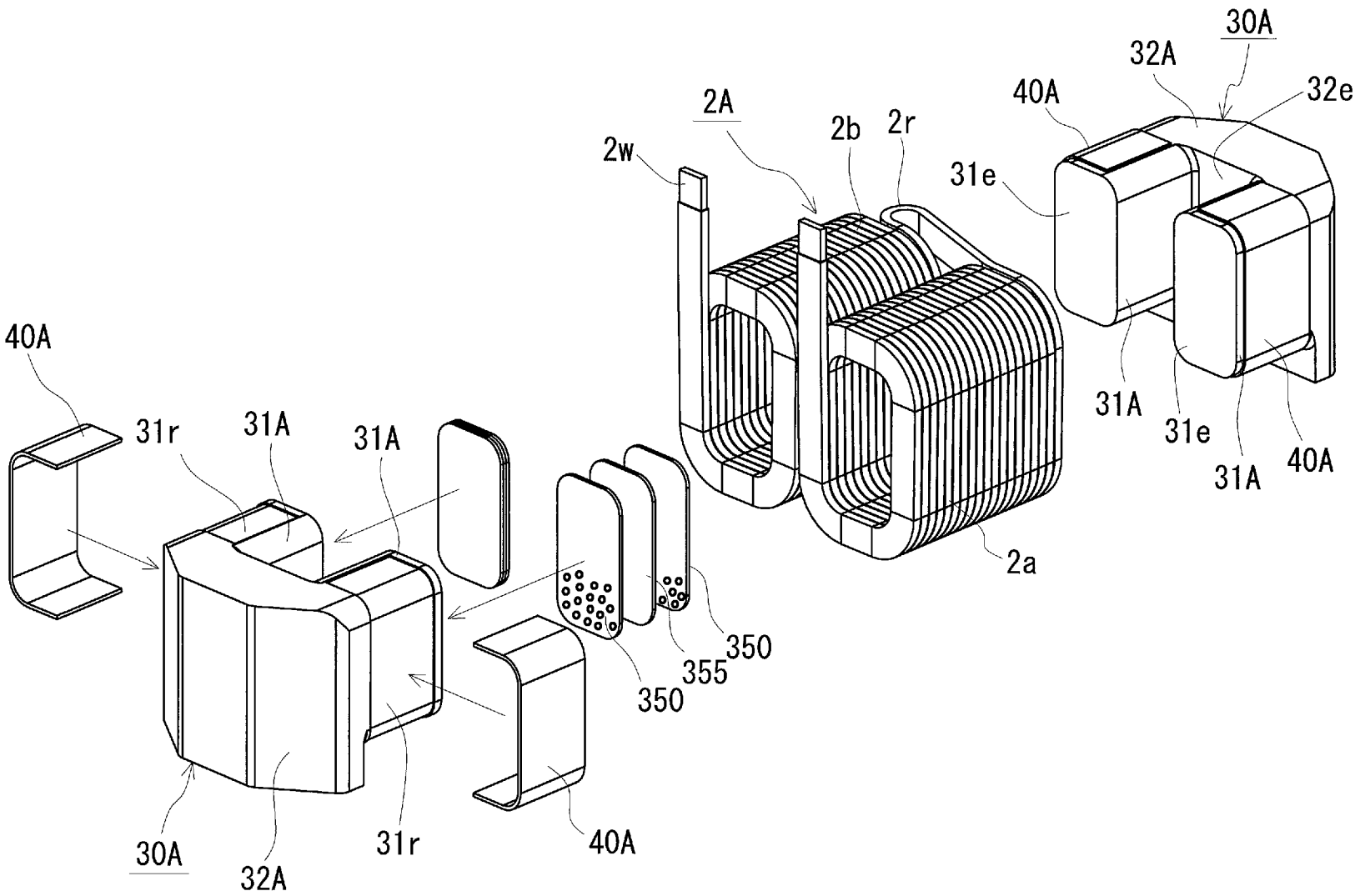
FIG. 2 is an exploded perspective view illustrating a manufacturing process for the reactor of the first embodiment.

As shown in FIG. 2, the coil 2A in this example has a pair of tubular winding portions 2*a* and 2*b* formed by winding one continuous winding wire 2*w* into a spiral shape, and a joining portion 2*r* that is formed by a portion of the winding wire 2*w* and connects the two winding portions 2*a* and 2*b*. The winding portions 2*a* and 2*b* are disposed in parallel (side-by-side) such that their axes are parallel to each other.

The winding wire 2*w* in this example is a coated rectangular wire (so-called enameled wire) that has a rectangular wire conductor (e.g., copper) and an insulating coating (e.g., polyamide imide) that surrounds the conductor, and the winding portions 2*a* and 2*b* are edgewise coils. The winding portions 2*a* and 2*b* in this example are shaped as square tubes that have rounded corners, and the inner peripheral faces thereof are each constituted by four flat faces and four curved faces that connect adjacent flat faces to each other (faces that form the corner portions).

The two end portions of the winding wire 2*w* are each lead out in an appropriate direction from the winding portions 2*a* and 2*b*, are provided with a terminal clamp (not shown), and are electrically connected to an external apparatus such as a power supply (not shown).

Magnetic Core

Overview

The magnetic core 3A includes a pair of U-shaped core pieces 30A as shown in FIG. 2. The core pieces 30A have the same shape, and each include short columnar portions (hereinafter, called core-insertion projection portions 31A) that are disposed so as to be inserted into the winding portions 2*a* and 2*b*, and a columnar outer core portion 32A that is disposed so as to project from the coil 2A, and on which the coil 2A is substantially not disposed. The core pieces 30A are each a solid body in which a pair of core-insertion projection portions 31A project from an inward end face 32*e* of the outer core portion 32A. The core-insertion projection portions 31A in this example are shaped as a cuboid with rounded corners, and the outer core portions 32A are shaped as rectangular columns having a trapezoidal upper face and lower face. The magnetic core 3A is obtained by assembling the two core pieces 30A to each other in a ring shape in which the end faces 31*e* of the core-insertion projection portions 31A face each other. When assembled into a ring shape, a gap corresponding to a gap length is provided between the end faces 31*e* of the core-insertion projection portions 31A of one of the core pieces 30A and the end faces 31*e* of the core-insertion projection portions 31A of the other core piece 30A, and this gap is the location where one gap member is disposed. The magnetic core 3A in this example has two of the aforementioned gaps, and includes a total of two gap members.

Core Piece

The core pieces 30A in this example are each constituted by a composite material that includes a soft magnetic powder and a resin. This composite material is molded using injection molding, cast molding, or the like. When using injection molding, molding can be performed easily even in the case of a complex solid shape such as a shape having recession portions 31*r* in portions as will be described later. A soft magnetic material powder made of a metal such as iron or an iron alloy (e.g., Fe—Si alloy or Fe—Ni allow), a non-metal such as ferrite, or the like can be suitably used as the soft magnetic powder. The resin serving as the binder in the composite material can be a thermosetting resin such as epoxy resin, or a thermoplastic resin such as polyphenylene sulfide (PPS) resin. Based on 100 volume percent of the composite material, the amount of soft magnetic powder contained in the composite material is 20 volume percent to 80 volume percent inclusive, or 30 volume percent to 70 volume percent inclusive, for example. The remaining portion is mainly a non-metallic organic material such as the aforementioned resins. In addition to the aforementioned resins, the remaining portion can further include a non-metallic inorganic material such as a ceramic (alumina, silica, etc.) for example (e.g., based on 100 volume percent of the composite material, 0.2 volume percent to 20 volume percent inclusive).

The magnetic properties of the composite material can be easily adjusted by adjusting the contained amounts of the soft magnetic powder, resin, non-metallic inorganic material, or the like. Due to including a nonmagnetic material such as a resin, the composite material tends to have a low relative permeability. With a magnetic core that includes core pieces having a low relative permeability, it is easier to reduce the gap length, and it is possible to reduce flux leakage in the gap portion. In a high-current application for example, providing a sufficient gap makes it unlikely for magnetic saturation to occur.

The core pieces 30A that are constituted by the composite material can include a surface resin layer (may contain the above-described ceramics) that is substantially formed by the resin in the composite material.

The shape of the core pieces 30A can be selected as desired. Besides the U shape described in this example, it is possible to use an E shape as in third and fourth embodiments that are described later, for example. Also, in this example, the lower faces of the outer core portions 32A project beyond the lower faces of the core-insertion projection portions 31A and are substantially planer with the lower faces of the winding portions 2*a* and 2*b* of the coil 2A. For this reason, the installation face of the reactor 1A is mainly constituted by the lower faces of the outer core portions 32A of the two core pieces 30A and the lower faces of the winding portions 2*a* and 2*b*. Due to being formed by both the coil 2A and the magnetic core 3A, the installation face of the reactor 1A has a sufficiently large installation surface area and has excellent stability. If the installation target includes a cooling mechanism, the installation face of the reactor 1A also functions as a heat dissipation face, and the reactor 1A will be excellent in terms of heat dissipation performance as well.

Gap Member

The gap members each have a thickness that is set according to the predetermined gap length. In the case of using a plurality of gap members, the thicknesses of the gap members can be values obtained by equally dividing the total gap length. In this example, the gap members each have the same thickness. Also, each gap member is a resin foam gap member 35A. The resin foam gap member 35A includes resin foam portions 35 in the contact regions that come into contact with the core pieces 30A, and includes a gap plate 355 at an intermediate position in the thickness direction.

The resin foam gap members 35A in this example each have the same configuration and same size. Each is specifically configured as a three-layer multilayer gap member that includes one gap plate 355 interposed between the end faces 31*e* of the core-insertion projection portions 31A of a pair of core pieces 30A, a resin foam portion 35 that is interposed between one face of the gap plate 355 and the end face 31*e* of the core-insertion projection portion of one of the core pieces 30A, and a resin foam portion 35 that is interposed between the other face of the gap plate 355 and the end face 31*e* of the core-insertion projection portion of the other core piece 30A. The resin foam portions 35 and the core pieces 30A as well as the resin foam portions 35 and the gap plate 355 are in close contact with each other due to volume expansion of the resin foam portions 35. Furthermore, in this example, the resin foam portions 35 have adhesiveness, and the resin foam portions 35 are in close contact with the core pieces 30A and the gap plate 355 due to the adhesive force of the resin foam portions 35 themselves as well. The magnetic core 3A is maintained in a ring shape by this close contact. For this reason, the resin foam portions 35 also function as an adhesive for integrating the magnetic core 3A, and there is no need to separately provide an adhesive for bonding the core pieces 30A to each other (the same follows in the later-described third embodiment as well).

Gap Plate

The gap plate 355 is a member that suppresses magnetic saturation of the magnetic core 3A, and has a lower relative permeability than the core pieces 30A. The gap plate 355 can be constituted by substantially only a nonmagnetic material, by a mixture of a nonmagnetic material and a soft magnetic material, or the like. Examples of the nonmagnetic material include a non-metallic inorganic material such as alumina, and a non-metallic organic material typified by a resin such as unsaturated polyester or PPS resin. Examples of the mixture include a mixture containing PPS resin and a soft magnetic powder such as iron powder. It is preferable that the gap plate 355 containing resin has excellent heat resistance to the extent of being able to withstand the temperature reached during heat treatment for forming the resin foam portions 35.

The shape and size of the gap plate 355 can be selected as desired. In a representative example, as shown in FIG. 2, the gap plate 355 has substantially the same shape as the end faces 31*e* of the core-insertion projection portions 31A of the core pieces 30A, and has the same size as or a smaller size than the surface area of the end faces 31*e*. In this case, the peripheral edge of the gap plate 355 does not project circumferentially outward from the core-insertion projection portions 31A, and a compact magnetic core 3A can be obtained.

Resin Foam Portion

The resin foam portions 35 are constituted by a plurality of air bubbles and a resin in which the air bubbles are contained. Due to being disposed adjacent to the coil 2A, it is preferable that this resin has excellent electrical insulation performance and has excellent heat resistance (e.g., 150° C. or more, or furthermore 180° C. or more) with respect to the highest temperature reached by the coil 2A. In the case where the reactor 1A is directly cooled by a liquid coolant or the like during use, it is preferable that the resin has excellent resistance to the liquid coolant or the like. Specific examples of the resin include PPS, nylon, and epoxy resin.

The resin foam portions 35 can be formed easily by using an unfoamed resin sheet 350 (FIG. 2; described in detail later) that has been cut to a predetermined shape and size, for example. For illustrative purposes, the air bubbles are shown formed on the unfoamed resin sheet 350, but it should be appreciated that the air bubbles are formed when the resin sheets 350 are foamed so as to form the resin foam portions 35. The resin sheets 350 having a predetermined shape are caused to foam while being sandwiched between the core pieces 30A, thus forming the resin foam portions 35. For this reason, the shape of the resin foam portions 35 roughly resembles the shape of the gap plate 355 and the end faces 31*e* of the core-insertion projection portions 31A of the core pieces 30A, and is flat plate-shaped.

Thickness Percentage

The percentage of the thickness of the resin foam portions 35 in the thickness of one resin foam gap member 35A (hereinafter, called the thickness percentage) can be selected as desired. The resin foam gap member can be constituted by substantially only resin foam as with a resin foam gap member 35B shown in the later-described second embodiment, and therefore the upper limit of the thickness percentage is 100%. As the thickness percentage increases, as the proportion of the resin foam portions 35 increases, and as the proportion of the gap plate 355 decreases, the greater the number of air bubbles between the core pieces 30A is, and the better the stress alleviation performance that can be expected is. On the other hand, as the thickness percentage decreases, and as the proportion of the gap plate 355 increases, the shorter the foaming time required for forming the resin foam portions 35 can be set, and the better the manufacturability is. Examples of the thickness percentage include 10% to 90% inclusive, and furthermore 30% to 70% inclusive. In this example, the thickness percentage is approximately 67% (the same follows in the later-described third embodiment as well).

Reactor Manufacturing Method

An example of a method for manufacturing the reactor 1A will be described below with reference to FIG. 2 mainly.

For example, it is possible to use the unfoamed resin sheets 350 in order to manufacture the reactor 1A that includes the resin foam gap members 35A that include the resin foam portions 35. Unfoamed resin sheets having a desired shape and size can be prepared by performing cutting, are easier to handle than a liquid adhesive or the like, and have excellent workability due to being able to be easily disposed at predetermined positions. Also, by merely disposing the unfoamed resin sheets, it is possible to easily form unfoamed resin layers that have a uniform thickness, and thus unfoamed resin sheets have excellent workability in view of this as well. The unfoamed resin sheets 350 are thinner than the foamed resin foam portions 35, and have excellent flexibility and can be easily disposed at locations having any shape, and thus unfoamed resin sheets have excellent workability in view of this as well. Due to having excellent manufacturability in this way, the reactor manufacturing method of the first embodiment uses the unfoamed resin sheets 350. First, the unfoamed resin sheets 350 will be described.

Unfoamed Resin Sheet

A commercially available or known resin sheet can be used for the unfoamed resin sheets 350. One example is a resin sheet that is made of a resin containing capsule particles that are filled with a liquid, and the resin is caused to expand by performing heating to vaporize the liquid such that the capsules expand. Also, if the unfoamed resin sheets 350 are in a semi-solidified state, a semi-cured state, or the like and have adhesiveness to a certain extent, it is possible to easily maintain the state where the resin sheets 350 are adhered to the gap plate 355 and the end faces 31*e* of the core-insertion projection portions 31A of the core pieces 30A, and therefore this is preferable. For example, in a foaming step and when assembling together the coil 2A, the core pieces 30A, and the laminated member including the unfoamed resin sheets 350 and the gap plate 355, it is possible to prevent the laminated member from falling off the core pieces 30A, prevent the gap plate 355 from detaching from the laminated member, and the like, and this achieves excellent assembly workability and manufacturability. If a resin sheet that contains an adhesive component or has an adhesive layer is used for the unfoamed resin sheets 350, they can be firmly bonded to the core pieces 30A and the gap plate 355 by the adhesive force of the foamed resin foam portions 35. It is desirable that release paper is attached to the adhesive layer in advance, and that the release paper is removed when disposing the resin sheets 350 on the core pieces 30A and the gap plate 355. By stacking a plurality of resin sheets that include an adhesive layer and then performing foaming, it is possible to easily form resin foam portions 35 that have a desired thickness even in the case where the resin sheet has a thin resin layer or has a low expansion rate.

The pre-foam thickness and expansion rate of the unfoamed resin sheets 350 can be selected from a range in which it is possible to ensure a volumetric expansion amount according to which the total thickness of the foamed resin foam portions 35 satisfies a thickness obtained by subtracting the thickness of the gap plate 355 from the predetermined gap length set between the two core pieces 30A. The expansion rate is obtained by the following expression: thickness of resin foam portion after foaming/thickness of unfoamed resin sheet before foaming. If the volumetric expansion amount may be low to a certain extent, such as in the case of including the gap plate 355 between the resin foam gap members 35A or the like as in this example and the later-described third embodiment or the like, the expansion rate can be set in the range of approximately 1.5 to 2 inclusive. In this case, the foaming time can be shortened, and thus has excellent manufacturability. If the volumetric expansion amount needs to be high to a certain extent, as in the later-described second and fourth embodiments for example, the expansion rate can be set in the range of 2 to 5 inclusive, or furthermore 3 or more, 4 or more, or 4.5 or more. The thickness of the unfoamed resin sheets 350 is set to 0.2 mm or more, for example.

It is desirable that the unfoamed resin sheets 350 are adjusted such that the resin foam portions 35 have a predetermined shape and size after foaming. In a representative example, if the unfoamed resin sheets 350 are set to the same size as or slightly smaller than the size of the surface of the gap plate 355 or the size of the end faces 31*e* of the core-insertion projection portions 31A of the core pieces 30A that form the space for the resin foam portions 35, the unfoamed resin sheets 350 can be disposed easily, and it is possible to suppress the amount of leakage from around the core pieces 30A after foaming. Resin foam that leaks from around the core pieces 30A can be used for bonding with the core pieces 30A. FIG. 2 shows an example in which the unfoamed resin sheets 350 and the gap plate 355 have the same shape and same size, that is to say have a size and shape (rectangular with rounded corners) that correspond to the end faces 31*e* of the rounded-corner cuboid core-insertion projection portions 31A of the core pieces 30A.

Manufacturing Method

The reactor manufacturing method of the first embodiment includes a disposition step in which the coil 2A and the pair of core pieces 30A are assembled together, and laminated members that include the unfoamed resin sheets 350 are disposed between the adjacent core pieces 30A, and a foaming step in which the resin sheets 350 are caused to foam by performing heat treatment necessary for foaming in a state where the gap between the core pieces 30A is restricted in accordance with the predetermined gap length.

Preparation Step

In this example, the coil 2A, the U-shaped core pieces 30A, a plurality of unfoamed resin sheets 350, and gap plates 355 are prepared. Also, two laminated members, which have a three-layer structure in which the surfaces of the gap plate 355 are sandwiched by unfoamed resin sheets 350, are prepared.

Disposition Step

For example, the two core-insertion projection portions 31A of one core piece 30A are inserted into the opening portions on one side of the winding portions 2*a* and 2*b* of the coil 2A. Next, the laminated members having the three-layer structure are inserted into the opening portions on the other side of the winding portions 2*a* and 2*b* until they abut against the end faces 31*e* of the core-insertion projection portions 31A, and then the two core-insertion projection portions 31A of the other core piece 30A are inserted into the same opening portions. Accordingly, the laminated members are clamped by the end faces 31*e* of the core-insertion projection portions 31A that face each other in the two core pieces 30A.

In the case where the unfoamed resin sheets 350 have adhesiveness, the resin sheets 350 are adhered to the respective end faces 31*e* of the core-insertion projection portions 31A of one core piece 30A, and then the coil 2A and the other core piece 30A are assembled together with the one core piece 30A on which the resin sheets 350 are disposed. Accordingly, the resin sheets 350 of the laminated members having the three-layer structure can be adhered to the respective end faces 31*e* of the core-insertion projection portions 31A that face each other in the two core pieces 30A. Due to the adhesiveness of the resin sheets 350 themselves, the state where the laminated members are interposed between the end faces 31*e* can be maintained even more reliably.

Foaming Step

The gap between the core pieces 30A for disposition of the laminated member that has the three-layer structure and includes the unfoamed resin sheets 350, or more specifically the gap between the end faces 31*e* of the core-insertion projection portions 31A that face each other, is restricted according to the predetermined gap length in order to be able to maintain the gap at the predetermined gap length. For example, the outer end faces or the like of the outer core portions 32A of the core pieces 30A are clamped with a restriction member (not shown). In this restricted state, heat treatment for foaming is performed to cause the resin sheets 350 to foam, thus forming the resin foam portions 35 that are constituted by resin foam.

It is desirable that the holding time and heating temperature in the heat treatment are appropriately selected according to the type of resin and the like so as to obtain the predetermined gap length. For example, the heating temperature is approximately in the range of 100° C. to 170° C. inclusive. In the case of using a resin (sheet) that needs only a low heating temperature and short holding time, it is possible to prevent heat damage to the coil 2A and the magnetic core 3A (particularly the resin component) during heat treatment, and therefore this is preferable. Also, using a resin (sheet) that can foam at a low temperature and in a short time contributes to an improvement in manufacturability and also a reduction in cost.

After foaming, in this example, the resin foam portions 35 are respectively formed on the two surfaces of each of the gap plates 355. The foamed resin is interposed between the end faces 31*e* of the core-insertion projection portions 31A that face each other, and is also in close contact with both the gap plate 355 and the end faces 31*e* of the core-insertion projection portions 31A. If the unfoamed resin sheets 350 have an adhesive component or an adhesive layer, they can be firmly adhered to both the gap plate 355 and the end faces 31*e* of the core-insertion projection portions 31A by the adhesive layer or the adhesive force of the adhesive.

Through the above-described foaming step, it is possible to manufacture the reactor 1A that includes the resin foam gap members 35A (multilayer gap members), which each include the gap plate 355 and the resin foam portions 35, that are disposed between the core-insertion projection portions 31A of adjacent core pieces 30A.

Actions and Effects Based on Main Feature Portions

In the reactor 1A of the first embodiment, at least one of the gap members is the resin foam gap member 35A that includes the resin foam portion 35 containing air bubbles, and therefore stress that arises from vibration or the like and can be applied to the reactor 1A during use can be reduced or alleviated by the resin foam gap member 35A. Accordingly, with the reactor 1A, it is possible to suppress damage such as breakage to portions in the vicinity of the connections between the core pieces 30A caused by this stress. In particular, even in the case where portions of the magnetic core 3A that are not in the vicinity of the connections between the core pieces 30A, such as the outer core portions 32A, are used for attachment to the installation target, it is possible to effectively suppress damage to the portions in the vicinity of the connections between the core pieces 30A.

Also, due to using the laminated member that includes the unfoamed resin sheets 350 and the gap plate 355, the reactor 1A can be manufactured easily, and has excellent manufacturability as well. In the case where the unfoamed resin sheets 350 have adhesiveness, the state of contact between the core pieces 30A and the resin sheets 350, and the state of contact between the gap plate 355 and the resin sheets 350 can be maintained by the resin sheets 350 themselves, and therefore the coil 2A and the magnetic core 3A can be assembled easily, there is no need for a support jig or the like for the resin sheets 350 during foaming, and this configuration has excellent manufacturability. Dimensional error of the core pieces 30A and the gap plate 355 can be absorbed by the volumetric expansion of the resin foam, and there is no need to perform precise dimensional adjustment, thus making it possible to shorten or eliminate the adjustment time, and this configuration has excellent manufacturability in view of this as well. In the reactor 1A of this example, the resin foam portions 35 function as an adhesive for bonding the core pieces 30A to each other, and therefore there is no need to separately provide an adhesive for integrating the magnetic core 3A, and this configuration has excellent manufacturability in view of this as well.

Furthermore, the core pieces 30A are each constituted by a composite material, and therefore for the following reasons, the reactor 1A of this example has even more excellent manufacturability, and is also compact. Also, even in the case of further including later-described coil fixing portions 4A, for the following reasons, the reactor 1A of this example has excellent manufacturability.

Manufacturability

1. It is possible to omit, for example, a resin covering member for the core pieces 30A such as an outer resin portion or an insulating intervening member that is called an insulator, a bobbin, or the like and is interposed between the core-insertion projection portions 31A and the winding portions 2*a* and 2*b* of the coil 2A, and it is possible to omit a covering step and an insulating intervening member disposition step.

2. Even if the gap length is reduced, there is no need to precisely adjust the thickness of the gap plate 355.

3. The foaming step of forming the resin foam portions 35 and the foaming step for a later-described coil fixing portions 4A can be performed at the same time.

Compactness

In the case where the gap length can be set relatively short easily, there is little flux leakage in the gap portions, and the surface resin layer mainly constituted by the resin in the composite material can be used as the insulation layer for insulation from the winding portions 2*a* and 2*b*, it is possible to dispose the winding portions 2*a* and 2*b* and the core-insertion projection portions 31A close each other.

Other Configurations

The reactor 1A of this example further includes coil fixing portions 4A that are constituted by resin foam in the tubular inner peripheral spaces between the inner peripheral faces of the winding portions 2*a* and 2*b* of the coil 2A and the outer peripheral faces of the portions of the magnetic core 3A that are disposed inside the winding portions 2*a* and 2*b* (here, the outer peripheral faces of the core-insertion projection portions 31A). By volumetric expansion of the resin foam, the coil fixing portions 4A restrict movement of the coil 2A such as deformation in the diameter direction, elongation and contraction in the axial direction, and rotation in the circumferential direction, and it is possible to prevent positional shift of the coil 2A relative to the magnetic core 3A caused by such movement of the coil 2A.

The above-described unfoamed resin sheets 40A can be used in the formation of the coil fixing portions 4A. It is desirable that the resin sheets 40A are disposed at predetermined positions on the outer peripheral faces of the core-insertion projection portions 31A and assembled together with the coil 2A, and then heat treatment for foaming is performed thereafter. This heat treatment can be performed at the same time as the heat treatment for forming the above-described resin foam gap members 35A. Accordingly, in an aspect including the coil fixing portions 4A, the reactor 1A can be manufactured by adding a disposition step for the resin sheets 40A, and this aspect has excellent manufacturability. In the case where the resin sheets 40A have adhesiveness, the reactor 1A has excellent workability for assembly together with the coil 2A as well. In the case where the resin sheets 40A have an adhesive component or an adhesive layer, the coil fixing portions 4A can come into close contact with the coil 2A and the magnetic core 3A after foaming.

Due to volumetric expansion by foaming, portions of the resin foam can enter the spaces between adjacent turns of the winding portions 2*a* and 2*b* of the coil 2A. This resin foam that enters the spaces between turns also constitutes portions of the coil fixing portions 4A.

If recession portions 31*r* are included at predetermined positions in the outer peripheral faces of the core-insertion projection portions 31A as shown in FIG. 2, the unfoamed resin sheets 40A can be positioned easily, and therefore this is preferable. It is desirable that the shape and size of the recession portion 31*r* are selected according to the shape and size of the resin sheets 40A. In particular, if the recession portions 31*r* are provided in a very shallow manner in the vicinity of the outer peripheral faces of the core-insertion projection portions 31A as shown in FIG. 2, it is possible to suppress a reduction in the magnetic path area that accompanies the formation of the recession portions 31*r*. Also, if the depth is greater than or equal to the thickness of the resin sheets 40A, the resin sheets 40A are unlikely to fall out of the recession portions 31*r* during assembly together with the coil 2 or the like, and are unlikely to become positionally shifted due to coming into contact with the inner peripheral faces of the winding portions 2*a* and 2*b* of the coil 2, and therefore this is preferable. In view of these points, it is thought to be preferable that the depth of the recession portions 31*r* is approximately greater than or equal to the thickness of the resin sheets 40A, and less than or equal to 1.3 times the thickness of the resin sheets 40A.

The range in which the coil fixing portions 4A are provided in the above-described inner peripheral spaces can be changed as desired. Besides the aspect in which one coil fixing portion 4A that is continuous in the circumferential direction is provided in the internal space as in this example, an aspect is possible in which a plurality of coil fixing portions that are discontinuous in the circumferential direction are provided in the internal space. In the former continuous aspect, the number of unfoamed resin sheets 40A that are used is small, the number of disposition steps is small, and manufacturability is excellent. In the latter discontinuous aspect, the coil fixing portions can be formed in only portions that are unlikely to influence the magnetic path (corner portions or the like in this example).

In this example, the coil fixing portions 4A are [shaped or] shaped and extend along a total of three flat portions including the upper and lower flat portions and the outer flat portion in the above-described inner peripheral space, and the two corners portions that connect the three flat portions to each other. When forming these coil fixing portions 4A, as shown in FIG. 2, it is desirable to dispose the resin sheets 40A so as to cover the faces other than the adjacent inward faces among the outer peripheral faces of the cuboid core-insertion projection portions 31A, which is three faces here, namely the upper and lower faces and the outward face, and the two corner portions that connect these three faces. Even if the gap between the adjacent core-insertion projection portions 31A is narrow, the resin sheets 40A can be disposed easily, and manufacturability is excellent. In this example, one recession portion 31*r* is provided at the formation location (region extending along the above-described three faces and two corner portions) of the coil fixing portion 4A in the outer peripheral face of one core-insertion projection portion 31A, and therefore the resin sheets 40A can be disposed even more easily.

The later-described second and third embodiments illustrate aspects in which, similarly to the present example, one coil fixing portion 4B or 4C that is continuous in the circumferential direction is provided in the space between an inner peripheral face of the coil and an opposing face of the magnetic core (FIGS. 3 and 5), and the later-described fourth embodiment illustrates an aspect in which a plurality of coil fixing portions 4D are provided in the circumferential direction.

If the space in which the coil fixing portions 4A to 4D are not provided in the inner peripheral space is used as a contact area for contact with the previously-described liquid coolant, or a storage area for a separately-prepared heat dissipation sheet (not shown), heat dissipation performance is improved.

Second Embodiment

Figure 3:
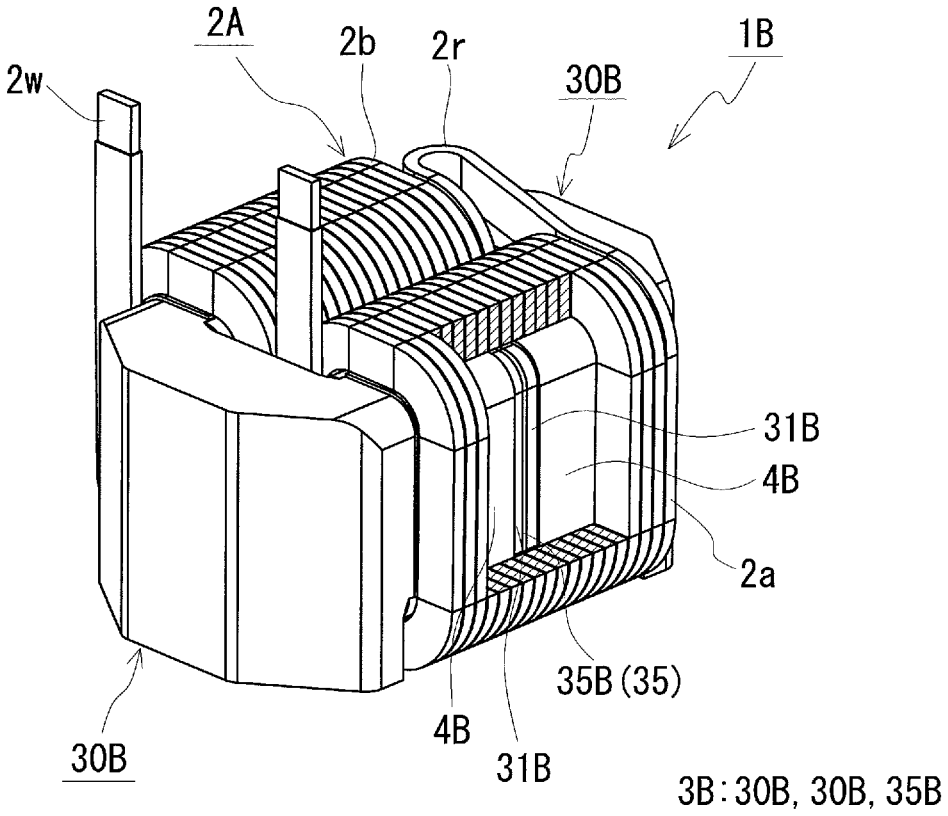
FIG. 3 is a schematic perspective view of a reactor of a second embodiment.
Figure 4:
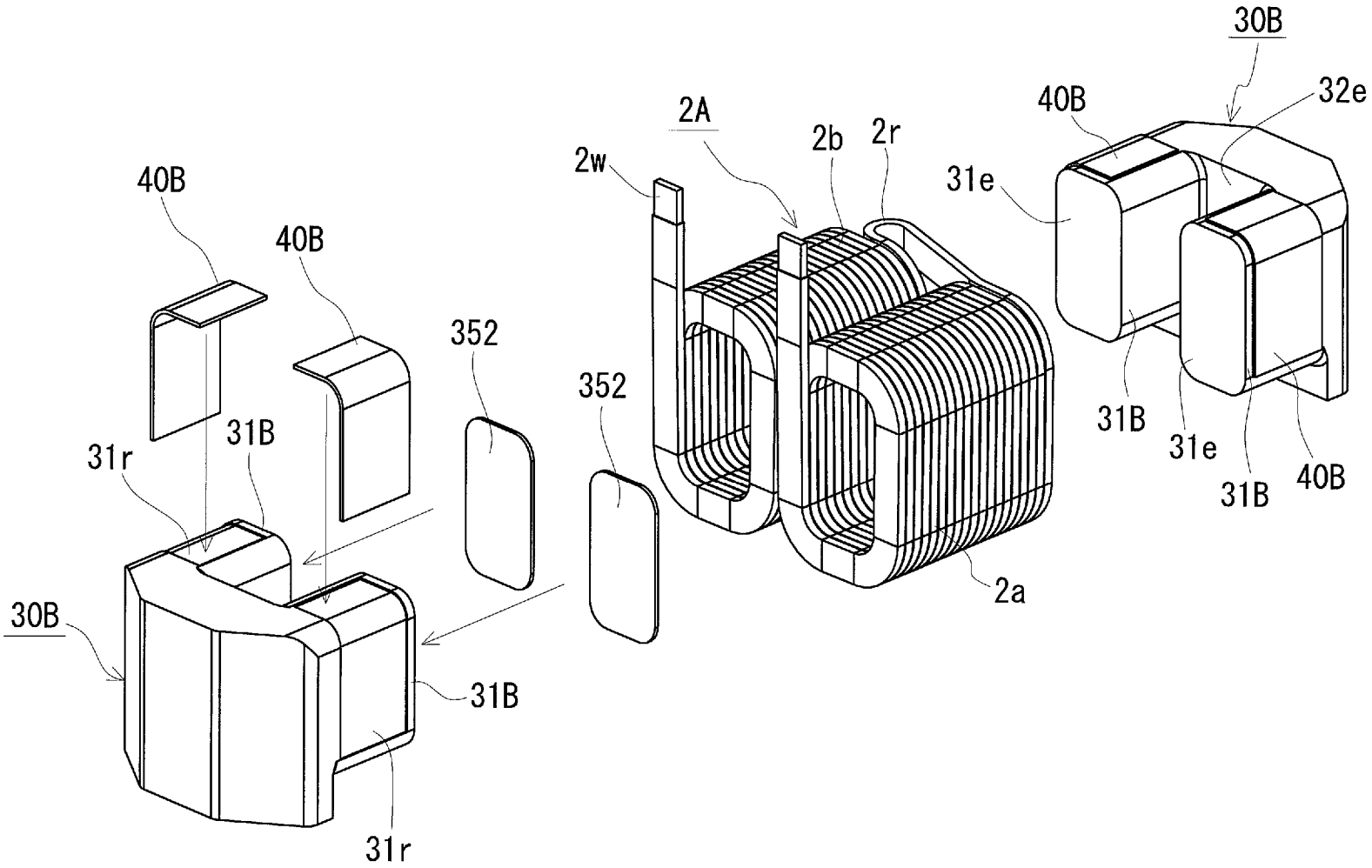
FIG. 4 is an exploded perspective view illustrating a manufacturing process for the reactor of the second embodiment.

A reactor 1B of a second embodiment will be described below with reference to FIGS. 3 and 4.

The basic configuration of the reactor 1B of the second embodiment is similar to that of the reactor 1A of the first embodiment, and includes a coil 2A that includes a pair of winding portions 2*a* and 2*b*, and a magnetic core 3B that includes two U-shaped core pieces 30B and two gap members interposed between the core pieces 30B. The gap members are both the resin foam gap member 35B that includes the resin foam portion 35. One difference in the reactor 1B of the second embodiment from the first embodiment is that the resin foam gap member 35B is entirely constituted by the resin foam portion 35 and does not include the gap plate 355 (FIG. 2). The following describes this difference in detail, and detailed descriptions have been omitted for overlapping configurations and effects.

The resin foam gap members 35B in this example each have the same configuration and same size, and are single-layer gap members that are entirely constituted by resin foam. The resin foam gap members 35B are each interposed between the end face 31*e* of the core-insertion projection portion 31B of one of the core pieces 30B that face each other and the end face 31*e* of the core-insertion projection portion 31B of the other core piece 30B, and have a thickness that corresponds to the predetermined gap length. The resin foam gap member 35B is in close contact with the two end faces 31*e* due to volumetric expansion of the resin foam. Furthermore, in this example, the resin foam portions 35 have adhesiveness, and the resin foam portions 35 are in close contact with the core pieces 30B due to the adhesive force of the resin foam portions 35 themselves as well. For this reason, similarly to the first embodiment, the resin foam portions 35 also function as an adhesive for integrating the magnetic core 3B, and there is no need to separately provide an adhesive for bonding the core pieces 30B to each other (the same follows in the later-described fourth embodiment as well).

Similarly to the first embodiment, the resin foam gap members 35B (resin foam portions 35) can be easily formed by using unfoamed resin sheets 352. It is sufficient to use resin sheets 352 having an expansion rate according to which the thickness after foaming is approximately greater than or equal to the predetermined gap between the end faces 31*e* of the core-insertion projection portions 31B. Also, in the disposition step described in the first embodiment, it is sufficient that the unfoamed resin sheets 352 are disposed between the end faces 31*e* of the core-insertion projection portions 31B that face each other instead of the above-described laminated members having a three-layer structure, and it is sufficient that the subsequent steps are similar to those in the first embodiment (FIG. 4).

In the reactor 1B of the second embodiment, at least one of the gap members is the resin foam gap member 35B that is constituted by resin foam containing air bubbles, and therefore stress that arises from vibration or the like and can be applied to the reactor 1B during use can be reduced or alleviated by the resin foam gap member 35B. Also, the reactor 1B can be easily manufactured by disposing the unfoamed resin sheets 352 between the core pieces 30B and causing the resin sheets 352 to foam in a state where the gap between the core pieces 30B is restricted according to the gap length, and this configuration has excellent manufacturability as well. In the case where the unfoamed resin sheets 352 have adhesiveness, assembly workability and workability during foaming are excellent, and this configuration has excellent manufacturability in view of this as well. In particular, in the reactor 1B of the second embodiment, the gap plate 355 is not provided, thus reducing the number of assembly parts in the manufacturing process for the resin foam gap member 35B, and this configuration has excellent manufacturability.

Also, the reactor 1B in this example has coil fixing portions 4B that are Γ shaped or ¬ shaped and extend along the outer corner portion in the inner peripheral space between the core-insertion projection portions 31B and the winding portions 2*a* and 2*b* of the coil 2A and the two flat portions on respective sides of this corner portion. One recession portion 31*r* is provided at the formation location (region extending along the upper face, the upper corner portion, and the outward side face connected to the corner portion) of the coil fixing portion 4B in the outer peripheral face of one core-insertion projection portion 31B, and therefore the resin sheets 40B can be disposed even more easily (FIG. 4). The flat portion on the lower side (disposition side) in the inner peripheral space and the space in the vicinity thereof can be used as the above-described space for improving heat dissipation performance.

Third Embodiment

Figure 5:
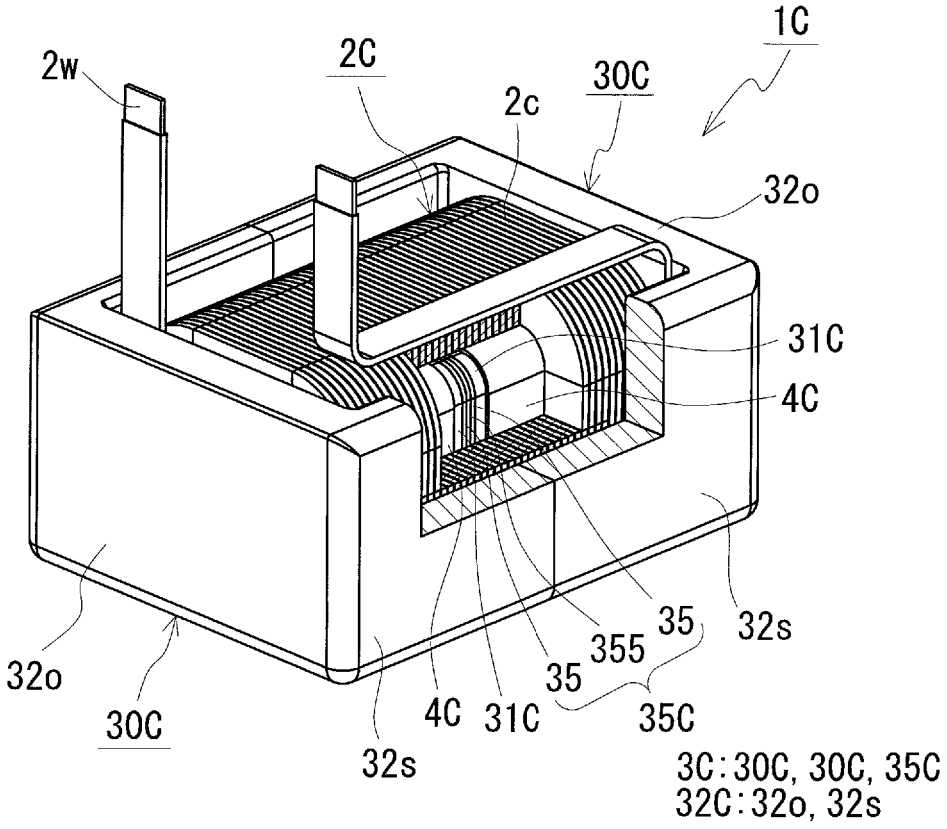
FIG. 5 is a schematic perspective view of a reactor of a third embodiment.

A reactor 1C of a third embodiment will be described below with reference to FIGS. 5 and 6.

The reactor 1C of the third embodiment is the same as the reactor 1A of the first embodiment with respect to including a coil, a plurality of core pieces, and a resin foam gap member that includes resin foam portions, but the shape of the coil, the shape of the magnetic core, and the number of gap members are different. Specifically, the reactor 1C includes a coil 2C that includes one winding portion 2*c*, and a magnetic core 3C that includes two E-shaped core pieces 30C constituted by a composite material and one gap member interposed between the core pieces 30C, and this gap member is a resin foam gap member 35C that includes a resin foam portion 35. In other words, the reactor 1C includes only one resin foam gap member 35C. Hereinafter, these differences will be described in detail, and detailed descriptions have been omitted for overlapping configurations and effects.

Reactor

Coil

Figure 6:
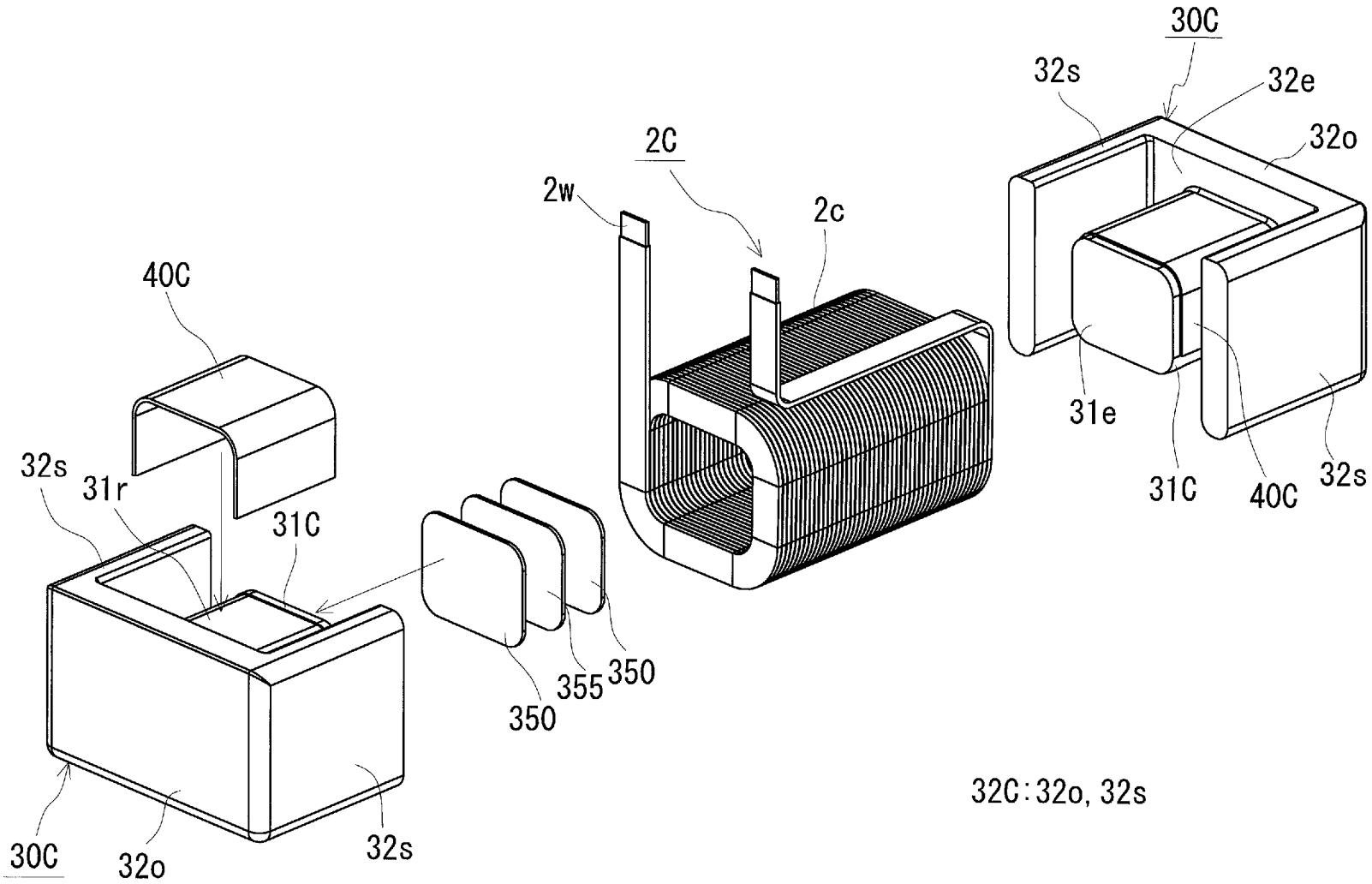
FIG. 6 is an exploded perspective view illustrating a manufacturing process for the reactor of the third embodiment.

As shown in FIG. 6, the coil 2C includes the tubular winding portion 2*c* formed by winding one continuous winding wire 2*w* into a spiral shape, and the end portion of the winding wire 2*w* is lead out in an appropriate direction. The winding portion 2*c* in this example is an edgewise coil that has the coated rectangular wire described in the first embodiment, and is shaped with rounded corners inside and outside a rectangular tube.

Magnetic Core

The magnetic core 3C of the reactor 1C includes two core pieces 30C as shown in FIG. 6, and one gap is provided between portions of the core pieces 30C (specifically, between core-insertion projection portions 31C that are described later). The core pieces 30C have the same shape, and have a shape corresponding to a so-called EE core. Specifically, the core pieces 30C each include a short columnar core-insertion projection portion 31C disposed so as to be inserted into the winding portion 2*c*, and an outer core portion 32C on which the coil 2C is substantially not disposed. The outer core portion 32C includes a plate-shaped joining portion 32*o* that is connected to the core-insertion projection portion 31C and faces one end face of the coil 2C, and a pair of outer peripheral portions 32*s* that are connected to the joining portion 32*o* and are disposed so as to cover portions of the outer peripheral face of the coil 2C. The core piece 30C is, so to speak, a solid in which the core-insertion projection portion 31C projects from the central portion of an inner end face 32*e* of the joining portion 32*o*, and the outer peripheral portions 32*s* project parallel to the core-insertion projection portion 31C from respective portions in the vicinity of the two edges of the inward end face 32*e*. Furthermore, end faces of the outer peripheral portions 32*s* project beyond an end face 31*e* of the core-insertion projection portion 31C. For this reason, in the state where the pair of core pieces 30C are assembled together such that the end faces of the outer peripheral portions 32*s* of the two core pieces 30C are in contact with each other, a gap having a predetermined size is provided between the end face 31*e* of the core-insertion projection portion 31C of one of the core pieces 30C and the end face 31*e* of the core-insertion projection portion 31C of the other core piece 30C. In the magnetic core 3C, this gap is a magnetic gap, and the resin foam gap member 35C is provided in this gap. The core-insertion projection portions 31C in this example are cuboid with rounded corners, and the joining portions 32*o* and the outer peripheral portions 32*s* are flat plate-shaped.

The magnetic core 3C forms a ring-shaped closed magnetic circuit when assembled such that the end faces 31*e* of the core-insertion projection portions 31C of the two core pieces 30C face each other and the end faces of the outer peripheral portions 32*s* face each other. This closed magnetic circuit forms the following loop: core-insertion projection portion 31C of first core piece 30C→resin foam gap member 35C→core-insertion projection portion 31C of second core piece 30C→joining portion 32*o* of second core piece 30C→outer peripheral portion 32*s* of second core piece 30C→outer peripheral portion 32*s* of first core piece 30C→joining portion 32*o* of first core piece 30C. The winding portion 2*c* is disposed in the gap between the core-insertion projection portion 31C and the outer peripheral portions 32*s* that is formed when the core pieces 30C are assembled together. The end faces of the winding portion 2*c* are in contact with or face the inward end faces 32*e* of the joining portions 32*o*.

In this example, the lower faces of the joining portion 32*o* and the outer peripheral portions 32*s* project beyond the lower face of the core-insertion projection portion 31C, and are substantially planar with the lower face of the winding portion 2*c* of the coil 2C. For this reason, the installation face of the reactor 1C is mainly constituted by the lower face of the outer core portion 32C and the lower face of the winding portion 2*c*.

Similarly to the resin foam gap member 35A of the first embodiment, the resin foam gap member 35C is a multilayer gap member that includes the gap plate 355 and the resin foam portions 35 respectively provided on the two surfaces of the gap plate 355. The thickness of the resin foam gap member 35C is set according to the predetermined gap length, and corresponds to the gap between the end faces 31*e* of the core-insertion projection portions 31C included in the two core pieces 30C. The shapes and sizes (areas) of the resin foam portions 35 and the gap plate 355 that constitute the resin foam gap member 35C are, similarly to the first embodiment, approximately the same as the shape (rectangular with rounded corners) and size (area) of the end faces 31*e* of the core-insertion projection portions 31C, and the resin foam portions 35 are flat plate-shaped. Similarly to the first embodiment, this resin foam gap member 35C can be formed using the unfoamed resin sheets 350 (FIG. 6) and the gap plate 355.

Reactor Manufacturing Method

The reactor 1C of the third embodiment can be manufactured in basically the same manner as the reactor 1A of the first embodiment. To give an overview, in this example, the coil 2C, a pair of core pieces 30C, and a laminated member having a three-layer structure in which the surfaces of the gap plate 355 are sandwiched by unfoamed resin sheets 350 are prepared (FIG. 6). The coil 2C and the pair of core pieces 30C are assembled together, and the laminated member including the unfoamed resin sheets 350 is disposed between the adjacent core pieces 30C. When the two core pieces 30C are assembled together such that the end faces of the outer peripheral portions 32*s* come into contact with each other as described above, a gap having a predetermined size is automatically provided between the end faces 31*e* of the core-insertion projection portions 31C, and the state where the laminated member is interposed between the end faces 31*e* can maintained. In the case where the resin sheets 350 have adhesiveness, the above-described interposed state can be maintained even more favorably by adhering the resin sheets 350 to the end faces 31*e*. In the third embodiment in which the above-described predetermined gap can be maintained by the core pieces 30C themselves, by appropriately controlling the expansion rate through adjusting the temperature or the like, it is possible to omit the restriction member that is described in the first embodiment and restricts the gap between the core pieces 30C. It is also possible to use the restriction member in the case of increasing the expansion rate, for example.

The two core pieces 30C are assembled together, the unfoamed resin sheets 350 are caused to foam in the state where the gap is restricted, and thus the resin foam portions 35 are formed. Accordingly, the reactor 1C that includes the resin foam gap member 35C (multilayer gap member) is obtained. The resin foam gap member 35C is in close contact with the two end faces 31*e* of the core-insertion projection portions 31C included in the two core pieces 30C due to volumetric expansion of the resin foam. Furthermore, in this example, the resin foam portions 35 have adhesiveness, and the resin foam portions 35 are in close contact with the core pieces 30C due to the adhesive force of the resin foam portions 35 themselves as well.

In the reactor 1C of the third embodiment, the gap member is the resin foam gap member 35C that includes the resin foam portion 35 containing air bubbles, and therefore stress that arises from vibration or the like and can be applied to the reactor 1C during use can be reduced or alleviated by the resin foam gap member 35C. Also, the reactor 1C can be easily manufactured by disposing the laminated member, which includes the unfoamed resin sheets 350 and the gap plate 355, between the core pieces 30C and causing the resin sheets 350 to foam, and this configuration has excellent manufacturability as well. In the case where the unfoamed resin sheets 350 have adhesiveness, assembly workability and workability during foaming are excellent, and this configuration has excellent manufacturability in view of this as well.

In particular, with the reactor 1C of the third embodiment, it is possible to omit the restriction member that restricts the gap between the core pieces 30C during foaming, and thus has excellent manufacturability in view of this as well. Also, in the reactor 1C, one resin foam gap member 35C is provided, and thus has excellent manufacturability in view of the fact that (α) the number of assembly parts used in the manufacturing process is reduced and (β) the gap between the core pieces 30C can be easily restricted precisely according to the gap length.

Also, the reactor 1C in this example has a coil fixing portion 4C that is Π shaped and extends along a total of three flat portions including the upper portion and the left and right flat portions in the inner peripheral space between the core-insertion projection portions 31C of the winding portion 2*c* of the coil 2C, and the two upper corners portions that connect the three flat portions to each other. One recession portion 31*r* is provided at the formation location (region extending along the upper face, the two upper corner portions, and the left and right faces) of the coil fixing portion 4C in the outer peripheral face of the core-insertion projection portion 31C of each of the core pieces 30C, and therefore the resin sheets 40C can be disposed easily. The flat portion on the lower side (disposition side) in the inner peripheral space and the space in the vicinity thereof can be used as the above-described space for improving heat dissipation performance.

Fourth Embodiment

Figure 7:
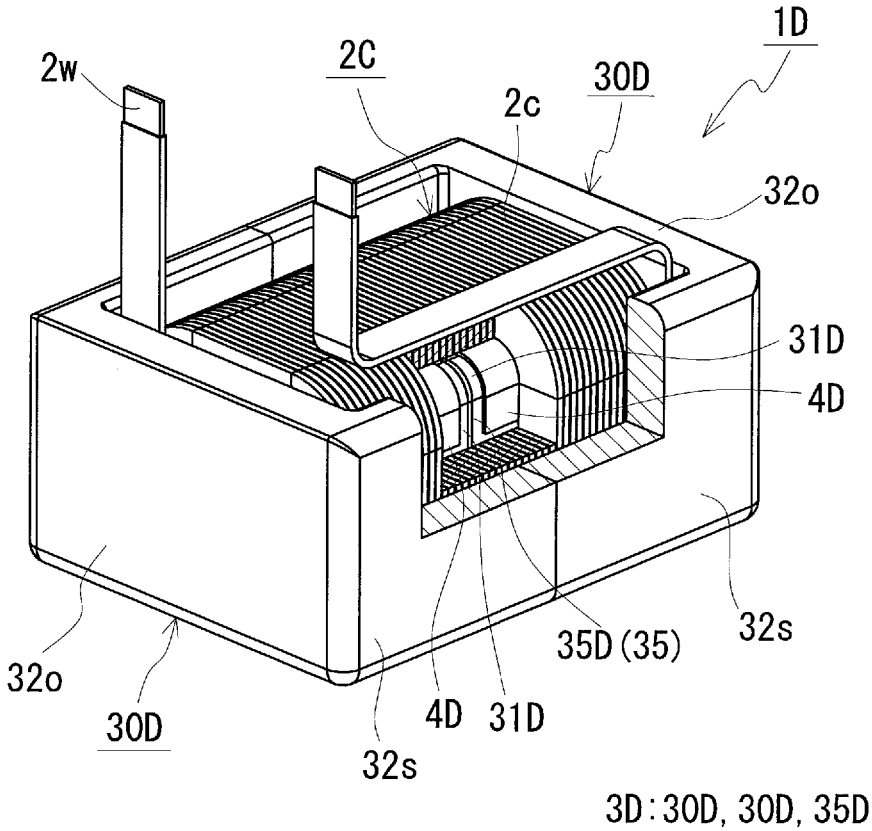
FIG. 7 is a schematic perspective view of a reactor of a fourth embodiment.
Figure 8:
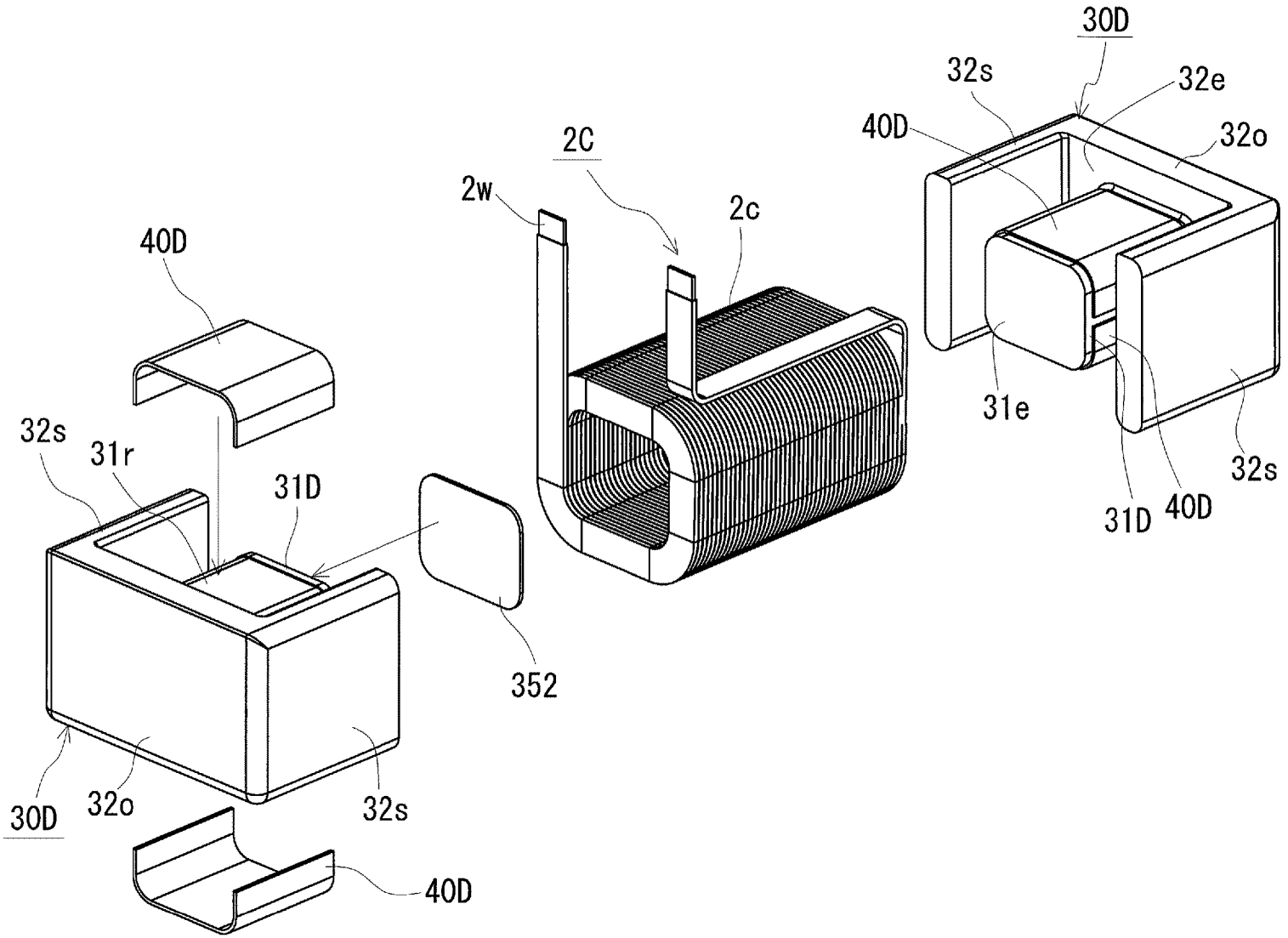
FIG. 8 is an exploded perspective view illustrating a manufacturing process for the reactor of the fourth embodiment.

A reactor 1D of a fourth embodiment will be described below with reference to FIGS. 7 and 8.

The basic configuration of the reactor 1D of the fourth embodiment is similar to that of the reactor 1C of the third embodiment, and includes a coil 2C that includes one winding portion 2*c*, and a magnetic core 3D that includes two E-shaped core pieces 30D and one gap member interposed between the core pieces 30D. The gap member is a resin foam gap member 35D that includes the resin foam portion 35. One difference in the reactor 1D of the fourth embodiment from the third embodiment is that the resin foam gap member 35D is entirely constituted by the resin foam portion 35 and does not include the gap plate 355 (FIG. 6), and this is the same as in the second embodiment. The reactor 1D is the same as the third embodiment in that only one resin foam gap member 35D is provided. Hereinafter, these differences will be described in detail, and detailed descriptions have been omitted for overlapping configurations and effects.

The resin foam gap member 35D in this example is a single-layer gap member that is entirely constituted by resin foam. The resin foam gap member 35D is interposed between an end face 31*e* of a core-insertion projection portion 31D of one of the core pieces 30D that face each other and an end face 31*e* of a core-insertion projection portion 31D of the other core piece 30D, and has a thickness that corresponds to the predetermined gap length. The resin foam gap member 35D is in close contact with the two end faces 31*e* due to volumetric expansion of the resin foam. The resin foam portion 35 in this example has adhesiveness, and the resin foam gap member 35D and the core pieces 30D are in close contact due to the adhesive force of the resin foam portion 35 itself as well. Similarly to the second embodiment, this resin foam gap member 35D (resin foam portion 35) can be easily formed by using an unfoamed resin sheet 352 that has a predetermined expansion rate.

In the reactor 1D of the fourth embodiment, the gap member is the resin foam gap member 35D that is constituted by resin foam containing air bubbles, and therefore stress that arises from vibration or the like and can be applied to the reactor 1D during use can be reduced or alleviated by the resin foam gap member 35D. Also, the reactor 1D can be easily manufactured by disposing the unfoamed resin sheet 352 between the core pieces 30D and causing the resin sheet 352 to foam in a state where the gap between the core pieces 30D is restricted according to the gap length, and this configuration has excellent manufacturability as well. In the case where the unfoamed resin sheet 352 has adhesiveness, assembly workability and workability during foaming are excellent, and this configuration has excellent manufacturability in view of this as well.

In particular, in the reactor 1D of the fourth embodiment, similarly to the second embodiment, the gap plate 355 is not provided, thus reducing the number of assembly parts in the manufacturing process for the resin foam gap member 35D, and making it possible to omit the gap restriction member similarly to the third embodiment, and due to only one resin foam gap member 35D being provided, it is possible to easily precisely restrict the gap between the core pieces 30D, and the reactor 1D has excellent manufacturability in view of these points as well.

Also, the reactor 1D in this example has a II-shaped coil fixing portion 4D (FIG. 7) and a U-shaped coil fixing portion 4D that are disposed in a vertical arrangement in the inner peripheral space between the winding portion 2*c* of the coil 2C and the core-insertion projection portion 31D. The one II-shaped coil fixing portion 4D is provided so as to extend along a total of three flat portions including the upper flat portion and portions of the left and right flat portions in the inner peripheral space, and along the two upper corner portions that connect these flat portions. The other U-shaped coil fixing portion 4D is provided so as to extend along a total of three flat portions including the lower flat portion and portions of the left and right flat portions in the inner peripheral space, and along the two lower corner portions that connect these flat portions. Two recession portions 31*r* are provided at the formation locations of the coil fixing portions 4D in the outer peripheral face of each core-insertion projection portion 31D, and thus the unfoamed resin sheets 40D can be disposed easily.

Variations

Modifications and additions such as the following can be made to the first to fourth embodiments described above.

(a) An aspect in which in the multilayer gap members described in the first and third embodiments, a resin foam portion 35 is disposed on only one surface of the gap plate 355

(b) An aspect in which the multilayer gap member includes a plurality of gap plates 355

(c) An aspect including both a multilayer gap member described above and in the first or third embodiment, and a single-layer gap member described in the second or fourth embodiment (d) An aspect including a core piece constituted by a powder compact and a magnetic steel plate (e) An aspect in which the magnetic core includes three or more core pieces (f) An aspect in which the magnetic core includes three or more gap members, and the gap members are each a multilayer gap member or a single-layer gap member described in the first to fourth embodiments or the like (g) An aspect including a resin mold portion that covers the outer peripheral surface of the magnetic core, the core pieces, or the assembly of the core pieces and the gap members. In this aspect, the recession portion 31*r* can be provided in the resin mold portion.

(h) An aspect in which in the case where the core pieces are constituted by a composite material, an attachment portion constituted by the composite material is integrally formed with the core pieces For example, the attachment portion is a through-hole or the like for attachment of a fastening member such as a bolt for fixing the reactor to the installation target.

(i) An aspect in which a sensor that measures a physical quantity of the reactor, such as a temperature sensor, a current sensor, a voltage sensor, or a magnetic flux, is provided (j) An aspect in which a heat dissipation plate that is constituted by a metal, a ceramic, or the like and has excellent thermal conductance and insulation performance is provided on the outer peripheral face of the coil (k) An aspect in which a bonding layer that is to be fixed to the installation target or the above-described heat dissipation plate (preferably constituted by an insulating material such as an insulating adhesive) is provided on the installation face of the reactor Note that the present invention is not limited to these examples, but rather is indicated by the scope of the claims, and all changes that come within the meaning and range of equivalence of the claims are intended to be embraced therein.

INDUSTRIAL APPLICABILITY

A reactor of the present invention is favorably applicable to a constituent part of a vehicle-mounted converter (typically a DC-DC converter) to be mounted in a vehicle such as a hybrid automobile, a plug-in hybrid automobile, an electrical automobile, or a fuel cell automobile, various converters such as a converter for an air conditioner, as well as a power conversion apparatus.

The invention claimed is:

1. A reactor comprising:

a coil; and a magnetic core that includes a plurality of core pieces and a plurality of gap members, the coil wound around the magnetic core, each of the plurality of core pieces having a pair of core-insertion projection portions, each of the core-insertion projection portions having a recession portion disposed on an outer peripheral surface of the respective core-insertion portions, the plurality of gap members interposed between at least one set of the core pieces, the magnetic core forming a closed magnetic circuit when the coil becomes excited, wherein a constituent material of the core pieces is a composite material containing a soft magnetic powder in an amount of 30 volume percent to 70 volume percent inclusive, a remaining portion being a non-metallic inorganic material in an amount of 20 volume percent or less and a resin, and one of the at least one gap members includes a resin foam, the resin foam having a plurality of air bubbles and contacts the core pieces and the coil so as to reduce a vibration applied to the reactor, an unfoamed resin sheet seated within the recession portion of the respective core-insertion projection portions.

2. The reactor according to claim 1, wherein one of the plurality of a members includes a gap plate having a first surface opposite a second surface and the resin foam is mounted on the first surface and the second surface of the gap plate.

3. The reactor according to claim 1, wherein the plurality of gap members is formed entirely of the resin foam.

* * * * *